United States Patent [19]

Eisinger

[11] 4,286,549

[45] Sep. 1, 1981

[54] STEAM GENERATOR SUPPORT SYSTEM

[75] Inventor: Frantisek L. Eisinger, Demarest, N.J.

[73] Assignee: Foster Wheeler Energy Corporation, Livingston, N.J.

[21] Appl. No.: 99,677

[22] Filed: Dec. 3, 1979

[51] Int. Cl.[3] ..... F22B 37/24

[52] U.S. Cl. ..... 122/510; 165/69; 165/82; 206/583

[58] Field of Search ..... 122/510; 165/69, 82; 206/583

[56] References Cited

U.S. PATENT DOCUMENTS

| | | | |
|---|---|---|---|
| 750,885 | 2/1904 | Nelson | 165/69 |
| 2,088,724 | 8/1937 | Rosencrants | 122/510 |
| 2,228,819 | 1/1941 | Emmet | 122/510 |
| 2,932,546 | 4/1960 | Marggraf et al. | 206/583 |
| 3,144,081 | 8/1964 | Skiba | 165/162 |
| 3,280,799 | 10/1966 | Schroedter | 122/510 |
| 3,323,496 | 6/1967 | Goldsack | 122/510 |
| 3,396,707 | 8/1968 | Bagley et al. | 122/510 |
| 3,735,952 | 5/1973 | Platus et al. | 206/583 |
| 3,850,149 | 11/1974 | Piaskowski | 122/510 |
| 4,071,961 | 2/1978 | Dietzel et al. | 34/108 |
| 4,113,007 | 12/1978 | Flower et al. | 122/510 |

*Primary Examiner*—Henry C. Yuen

*Attorney, Agent, or Firm*—Marvin A. Naigur; John E. Wilson; John J. Herguth, Jr.

[57] ABSTRACT

An apparatus and method are provided for top-supporting a steam generator from a frame which is connected to a base. A plurality of dampers are connected between upstanding frame members and the steam generator, acting to absorb a portion of the energy resulting from dynamic loads imparted between the frame and the steam generator.

7 Claims, 2 Drawing Figures

STEAM GENERATOR SUPPORT SYSTEM

BACKGROUND OF THE INVENTION

This invention relates to structural support systems, and has particular application to top-supported steam generators.

Relatively large vapor generators, such as steam generating units used by utility companies, are usually hung from a frame in order to allow for thermal expansion of their components during their operation. Such frames include upstanding members disposed adjacent the front, rear and sides of the steam generator, and a laterally extending member disposed adjacent the roof of the steam generator. A plurality of tie rods are employed to hang the steam generator from its upper extremities, being connected between the roof of the vapor generator and the laterally extending frame member. A plurality of ties can also be used to connect the steam generator from its front, rear and sides to the upstanding frame members. When these ties are used the steam generator is spaced from the upstanding frame members, with the ties being disposed within the space therebetween. It is to be understood that steam generators possess certain characteristics which distinguish them from other type of large top-supported machines, and therefore lend themselves to the use of the present invention, whereas other large devices may not be suited for such use. Steam generators are generally large devices of great mass, often standing well over 150 ft. high. Yet the boundary walls of a steam generator are relatively flexible members. Because of these characteristics, top-supported steam generators have relatively low natural frequencies, tending to react to excitation frequencies of 1 cycle per second or lower.

The dynamic loading toward which the present invention is directed principally takes place during earthquakes and/or wind loading. The excitation frequencies associated with an earthquake usually are higher than the natural frequencies of the steam generator. Therefore, the steam generator tends to remain stationary, during an earthquake while its base moves.

It has been suggested to tie the steam generator rigidly to the upstanding support members in an attempt to transmit dynamic loads from the support system to the steam generator, and thereby relieve the support system of certain stresses. However, when this is done, the steam generator must be specially designed and constructed to withstand such loads which are transmitted from the support system.

As an alternative it has been suggested to employ ties which are designed to disconnect or break during the initial period of response by the steam generator to dynamic loading by the support system, thereby allowing the steam generator to be in a free-swinging mode. This approach virtually eliminates dynamic loading of the steam generator but can result in large displacement of the steam generator relative to the support system, thereby requiring that the support system be designed to accommodate relatively high stresses.

The present invention provides an apparatus and method for transmitting dynamic load from a structural support system to a top-supported steam generator, and for dissipating energy so as to lessen stresses on both the support system and the steam generator. The steam generator is dynamically isolated from the support system through the use of a plurality of dampers connected therebetween. A typical top-supported steam generator has a large mass and tends to serve as a "support" to a deflected support system which tends to "lean" against the steam generator; as a consequence, the support system experiences relatively little deflection and stress while the energy introduced to the support system during an earthquake is dissipated in the dampers.

SUMMARY OF THE INVENTION

In accordance with the apparatus aspect of the present invention an apparatus is provided for top-supporting a steam generator from a base comprising a frame including a laterally extending member disposed adjacent the top of said steam generator and spaced vertically from said steam generator, and a plurality of upstanding members connected between said laterally extending member and said base. Means are provided for connecting the steam generator to the laterally extending member, and additional means are provided for connecting the steam generator to the upstanding members. The latter means include a plurality of dampers, arranged to absorb energy and load transmitted between said frame and said steam generator.

According to the method aspect of the present invention, a method is provided for top-supporting a steam generator from a frame, of the type wherein the steam generator is connected to a laterally extending frame member by a plurality of vertically disposed connectors, and the lateral frame member is connected to upstanding frame members secured to a base. The method includes the steps of disposing a plurality of dampers between the steam generator and the upstanding frame members, and connecting the dampers at respective first ends to sides of the steam generator and at respective second ends to the upstanding frame members. The dampers absorb energy transmitted between the frame and the steam generator and act to suppress dynamic loading of the heavy member by the frame.

DESCRIPTION OF THE PREFERRED EMBODIMENT

Figure 1:
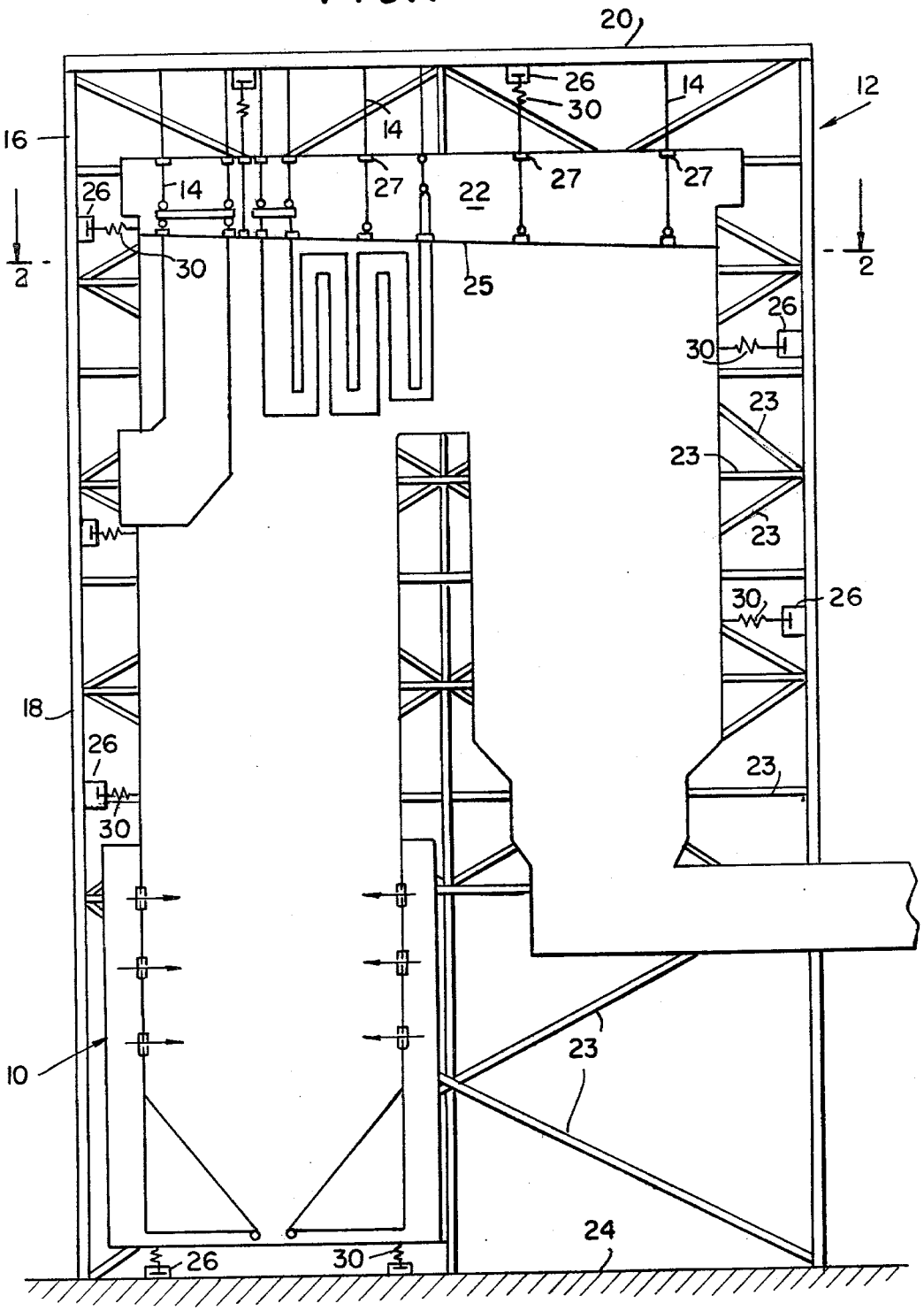
FIG. 1 is an elevational view of a top-supported steam generator employing the dampers of the present invention.
Figure 2:
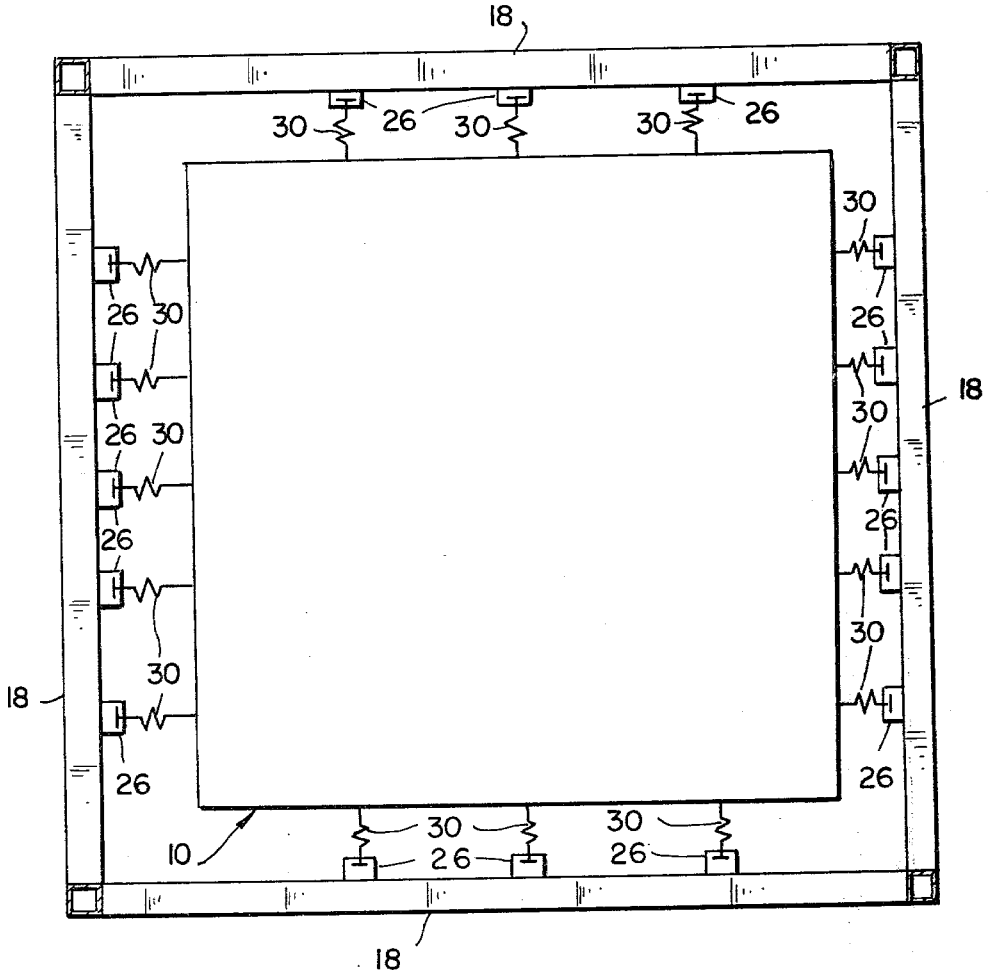
FIG. 2 is a plan view taken along line 2—2 of FIG. 1, and showing the disposition of the dampers of the present invention about the periphery of the steam generator.

Referring to FIG. 1, a steam generator 10 is shown hung from a support system 12. The support system 12 includes hanger rods 14, and a frame 16. Frame 16 is made up of a plurality of upstanding members 18 adjacent the periphery of the steam generator 10, and a laterally extending member 20 disposed above penthouse 22 of steam generator 10. The upstanding members are defined by a network of steel girders 23, some of which extend vertically, others of which extend horizontally, and yet others of which extend at an angle to horizontal. Upstanding support members 18 are secured at one end to a base 24, which can be the ground or a platform, for example.

The laterally extending member 20 of the frame 16 is connected to upstanding members 18 at their ends opposite from the base 24; member 20 also comprises a plurality of steel girders connected to one another, and generally defining a roof disposed over the top of the steam generator. It is to be understood that although the upstanding members 18 and horizontally extending member 20 herein shown are not solid, solid members, such as reinforced concrete walls, or sheet metal walls can be employed.

Support system 12 also includes a plurality of hanger rods 14 which are connected at first ends to laterally extending member 20 and opposite ends to roof 25 of steam generator 10. A plurality of seals 27 are located adjacent the rods 14 where they penetrate the penthouse ceiling.

In the preferred embodiment there are no means for rigidly securing the steam generator to the upstanding members 18 of frame 16; dampers 26 and springs 30 are used for flexibly connecting steam generator 10 to the upstanding members 18. However, in some cases it may be desirable to use rigid ties with the springs and dampers of the present invention. When used, rigid ties would be properly spaced from the springs and dampers so as not to prevent these components from acting as intended. If desired, dampers and springs can be used to connect steam generator 10 to the horizontally extending member 20 of frame 16 in combination with hanger rods 14, as shown in FIG. 1. Additionally, as also shown in FIG. 1, springs and dampers can be connected between base 28 and the underside of the steam generator, if desired.

Dampers 26 react to displacement of the components to which they are attached, so as to absorb energy as well as carry load transmitted between the steam generator 10 and frame 16.

In the preferred embodiment a plurality of deformable structures, preferably springs, 30 are also connected between the steam generator 10 and frame 16. Although a spring is the preferred form of deformable structure, other elastic stored-energy machine elements capable of recovering their basic form or position, can be employed. The springs absorb energy, and also affects the vibration response characteristic of the overall steam generator.

In the preferred embodiment springs 30 are serially connected to dampers 26, and combination spring-damper members are connected between frame 16 and the steam generator 10. It is to be understood that the springs could be arranged in parallel with the dampers, or some springs could be in parallel with some dampers, while other springs were serially connected to respective dampers.

In operation, when frame 16 moves laterally relative to steam generator 10, for example, during an earthquake or wind loading, the frame tends to dynamically load steam generator 10 through the damper assemblies, and through the spring assemblies when used. A portion of the dynamic load is absorbed by dampers 26, and another portion is absorbed by springs 30 when used. Dampers 26 react to lateral displacement of upstanding members 18, tending to resist the lateral movement of members 18. Since the steam generator is of relatively large mass, it acts as a "support" for the frame 16. Although some load will be imparted to steam generator 10 through the springs and dampers, the amount of load is considerably less than that which would have otherwise been transmitted, if the steam generator were completely rigidly tied to frame 16. Since the dampers, springs and steam generator absorb load from frame 16 as a result of its displacement, considerable energy is transmitted away from the support system. Therefore the frame 16 need not be designed to absorb the total energy associated with potential dynamic loading, and yet is not subjected to high stresses.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. An apparatus for top-supporting a steam generator from a base, said steam generator including relatively flexible front, side and rear walls, a roof and a floor and having a low natural frequency, said apparatus comprising:

(a) a frame including a laterally extending member disposed above said steam generator and spaced vertically from said steam generator; and a plurality of upstanding members connected at respective upper ends to said laterally extending member and at respective lower ends to said base;

(b) means for connecting said steam generator to said laterally extending member; and (c) means for connecting said steam generator to said upstanding members, said means including a plurality of dampers disposed at a plurality of elevations along the height of said steam generator, adapted to react to lateral displacement of said upstanding members and arranged to absorb forces resulting from lateral displacement of said frame, and a plurality of springs, said dampers arranged such that at least one of said springs is serially connected to a respective one of each of said dampers, said springs and dampers together defining combination spring-dampers connected between said steam generator and said upstanding frame members, whereby said spring-dampers absorb and dissipate energy transmitted during displacement of said frame toward said upstanding members such that stressing of said frame and said steam generator due to said displacement is lessened.

2. The apparatus of claim 1 further comprising additional springs and dampers connected between said laterally extending frame member and said steam generator.

3. The apparatus of claim 1 wherein said upstanding frame member includes a plurality of interconnected metal girders.

4. The apparatus of claim 3 wherein said steam generator includes a furnace section, said furnace section including said floor, and further comprising additional springs and dampers connected between said floor and said base.

5. The apparatus of claim 3 wherein said means for connecting said steam generator to said upstanding members are arranged in a plurality of rows.

6. In a method of top-supporting from a base a steam generator including relatively flexible front, rear and side walls, a floor and a roof and having a low natural frequency, said method being of the type wherein said steam generator is hung from a frame, said frame including a laterally extending member adjacent the top of said steam generator and a plurality of upstanding frame members connected between said base and said laterally extending members, the improvement comprising the steps of:

(a) disposing a plurality of dampers at a plurality of elevations along the height of said steam generator, said dampers being adapted to react to lateral displacement of said upstanding members and located between said steam generator and said upstanding frame members, and (b) connecting said dampers between said steam generator and said upstanding frame members and connecting springs between said steam generator and said frame members, each of said springs being serially connected to respective ones of said dampers, each spring and damper together forming a combination spring-damper connected between said steam generator and said upstanding frame members, whereby said spring-dampers will absorb and dissipate energy transmitted from said frame through said upstanding members toward said steam generator such that stress of said frame and said steam generator by movement of said frame is lessened.

7. The method of claim 6 further comprising the step of connecting a plurality of springs and dampers between said steam generator and said laterally extending frame member.

* * * * *